US011819151B2

(12) United States Patent
Baldridge

(10) Patent No.: US 11,819,151 B2
(45) Date of Patent: Nov. 21, 2023

(54) STABILIZING CUP HOLDER FOR A GOLF BAG

(71) Applicant: Daniel Baldridge, Seattle, WA (US)

(72) Inventor: Daniel Baldridge, Seattle, WA (US)

( * ) Notice: Subject to any disclaimer, the term of this patent is extended or adjusted under 35 U.S.C. 154(b) by 0 days.

(21) Appl. No.: 17/872,036

(22) Filed: Jul. 25, 2022

(65) Prior Publication Data

US 2023/0033734 A1 Feb. 2, 2023

Related U.S. Application Data

(60) Provisional application No. 63/226,338, filed on Jul. 28, 2021.

(51) Int. Cl.

| | |
|---|---|
| ***A63B 57/00*** | (2015.01) |
| ***A47G 23/02*** | (2006.01) |
| *A63B 55/00* | (2015.01) |

(52) U.S. Cl.

CPC ..... *A47G 23/0216* (2013.01); *A63B 55/00* (2013.01); *A63B 55/408* (2015.10); *A63B 2225/682* (2013.01); *Y10S 224/926* (2013.01)

(58) Field of Classification Search

CPC ..... A47G 23/0216; A47G 23/0225; A47G 23/0266; A47G 23/0284; A47G 2400/086; A47G 29/08; A63B 57/20; A63B 60/00; A63B 2225/682; B62B 2202/023; B62B 2202/404; Y10S 224/926

USPC .... 206/315.3, 217; 211/77, 78, 80, 85, 70.2, 211/81, 74; 220/737, 751; 224/926, 553, 224/406, 544, 148.4, 374, 401, 274, 414, 224/737; 248/311.2, 318, 682, 188.5, 314

See application file for complete search history.

(56) References Cited

U.S. PATENT DOCUMENTS

| | | | | | |
|---|---|---|---|---|---|
| 2,470,694 | A | * | 5/1949 | Foo | A61J 9/0638 248/106 |
| 2,926,879 | A | * | 3/1960 | Dietrich | B63B 29/12 224/406 |
| 3,051,428 | A | * | 8/1962 | Schult | E06C 7/146 248/231.51 |
| 3,112,910 | A | * | 12/1963 | Bal | A01K 97/10 248/161 |
| 3,131,842 | A | * | 5/1964 | Dingle, Jr. | A63B 55/60 248/314 |
| 3,269,683 | A | * | 8/1966 | Shinaver | A63B 55/60 248/210 |
| 3,306,649 | A | * | 2/1967 | Zagwyn | A63B 47/02 D21/721 |
| 3,313,508 | A | * | 4/1967 | Mancl | B62B 9/00 248/229.11 |
| 3,528,591 | A | * | 9/1970 | Herbulis | A63B 55/60 224/558 |

(Continued)

*Primary Examiner* — Gideon R Weinerth

(74) *Attorney, Agent, or Firm* — Walker Griffin Weitzel; Alloy Patent Law

(57) ABSTRACT

The present invention discloses a stabilizing cup holder for any type of golf bag. The disclosed invention is a significant improvement in the state of the art by allowing players to store canned beverages simply and effectively in the cup holder while playing the golf. The cup holder has been disclosed that fits inside any golf bag, just as any golf club would. This allows and provides a place for the players to place their drinks (such as the canned beverages) while walking, or while their golf bags are on the ground.

11 Claims, 4 Drawing Sheets

(56) References Cited

U.S. PATENT DOCUMENTS 3,840,204 A * 10/1974 Thomas ..... B63B 29/12 224/406
3,842,981 A * 10/1974 Lambert ..... B60N 3/103 211/74
3,938,869 A * 2/1976 Josey ..... A63B 55/60 312/45
4,248,397 A * 2/1981 Casper ..... A47G 23/0216 248/311.2
4,474,354 A * 10/1984 Field ..... F16M 11/10 248/580
4,721,276 A * 1/1988 Moss ..... B60N 3/10 248/205.2
4,819,843 A * 4/1989 Nakayama ..... B60N 3/103 220/737
4,844,399 A * 7/1989 Harm ..... A63B 55/60 248/311.2
5,152,489 A * 10/1992 Christensen ..... A63B 47/002 248/230.1
5,190,257 A * 3/1993 Gradei ..... E06C 7/14 248/231.71
5,295,650 A * 3/1994 Brandt ..... A47C 7/68 108/26
5,297,570 A * 3/1994 Conner ..... A45B 11/00 135/25.1
D346,141 S * 4/1994 McConnell ..... D12/129
5,320,263 A * 6/1994 Kobylack ..... A63B 55/408 224/558
5,340,006 A * 8/1994 Li ..... A45F 5/00 224/181
5,409,154 A * 4/1995 Blount ..... A63B 55/60 280/304.5
5,433,361 A * 7/1995 O'Malley ..... A63B 55/408 224/558
5,464,183 A * 11/1995 McConnell ..... B62B 9/26 224/407
5,480,078 A * 1/1996 Verrette ..... B62B 1/06 280/DIG. 6
5,484,128 A * 1/1996 Franco, Sr. ..... F16M 11/041 248/230.4
5,484,129 A * 1/1996 Megal ..... A63B 55/408 248/311.2
5,489,055 A * 2/1996 Levy ..... B60N 3/103 224/544
5,494,248 A * 2/1996 Pratt ..... A63B 55/408 248/230.8
5,579,968 A * 12/1996 Staschiak ..... A63B 55/408 224/555
5,597,363 A * 1/1997 Leote ..... A63B 55/10 473/282
5,657,957 A * 8/1997 Graham ..... A45B 11/00 248/311.2
5,664,718 A * 9/1997 Vine ..... B60N 3/103 248/312.1
5,673,835 A * 10/1997 Kalat ..... B62J 11/04 224/544
5,775,654 A * 7/1998 Price ..... A47G 23/0225 248/103
5,823,496 A * 10/1998 Foley ..... A47G 23/0225 248/314
6,032,917 A * 3/2000 Shannon ..... F16M 13/02 248/529
6,142,437 A * 11/2000 Wilkins, Jr. ..... F16M 13/022 248/231.71
6,371,866 B1 * 4/2002 Rivera ..... A63B 53/02 473/307
7,153,218 B1 * 12/2006 Elkin ..... A63B 55/10 473/282
7,537,016 B1 * 5/2009 You ..... A45B 3/00 135/25.4
9,016,651 B2 * 4/2015 Webb ..... A47G 23/0225 248/311.2
10,143,614 B1 * 12/2018 Pelletier ..... A61H 3/02
10,470,536 B1 * 11/2019 Lundaas ..... A45B 3/00
10,471,314 B1 * 11/2019 Tran ..... A63B 55/30
2003/0197104 A1 * 10/2003 Heybl ..... B60N 3/108 248/314
2004/0050409 A1 * 3/2004 Lin ..... A45B 17/00 135/16
2005/0079923 A1 * 4/2005 Droppleman ..... A63B 55/00 473/305
2006/0037825 A1 * 2/2006 Dayton ..... A47G 23/0225 190/110
2007/0138225 A1 * 6/2007 Duchesne ..... B60R 11/00 224/544
2007/0238543 A1 * 10/2007 Cooper ..... A63B 53/02 473/288
2009/0206098 A1 * 8/2009 Garahan ..... A45F 5/02 220/737
2009/0308767 A1 * 12/2009 Brydon ..... A45B 11/00 248/539
2012/0199705 A1 * 8/2012 Will ..... A45F 3/44 248/121
2014/0135142 A1 * 5/2014 David, Sr. ..... A63B 47/02 473/282
2014/0332644 A1 * 11/2014 Davis ..... A45F 3/44 248/146
2016/0081505 A1 * 3/2016 Berg ..... A45F 5/00 224/401
2016/0227949 A1 * 8/2016 Klugh ..... A45C 13/28
2022/0314858 A1 * 10/2022 Serpis ..... B60N 3/00
2023/0033734 A1 * 2/2023 Baldridge ..... A47G 23/0216
2023/0180953 A1 * 6/2023 Gu ..... A47G 23/0225 220/737

* cited by examiner

STABILIZING CUP HOLDER FOR A GOLF BAG

CROSS-REFERENCE TO RELATED PATENT DOCUMENTS

This patent application claims the benefit of priority of U.S. Provisional Application No. 63/226,338, entitled "STABILIZING CUP HOLDER FOR A GOLF BAG," filed 28 Jul. 2021, which is hereby incorporated herein by reference in its entirety.

TECHNICAL FIELD OF THE INVENTION

The present invention relates in general to the field of golf equipment, and, more particularly, to a cup holder for a golf bag.

BACKGROUND OF THE INVENTION

A golf bag is a bag that is generally used for carrying golf clubs and balls. A number of useful improvements have been developed to address the dual problems of carrying golf bags and accessing golf accessories from the pockets and compartments of golf bags. Generally, while playing golf, players often drink canned beverages such as beer or soda. However, the players always find difficulty in storing the canned beverages while drinking and playing the golf. Due to lack of appropriate storage, the players will have to either finish drinking and then participate in playing golf, or the players will have to keep the canned beverages on the ground, or the players will have to ask the caddie to carry the canned beverages. In all the cases, the players' experience is compromised in some way. Thus, it may be essential to have a cup holder for storing canned beverages. Currently, there is no cup holder in the market that works with an isolated golf bag. Accordingly, there is a need for a device that will facilitate the effective and efficient storage of the canned beverages so the players can enjoy drinking and participate in the golf play without compromising the overall experience of the players. The present invention discloses a cup holder that fits inside any golf bag, just as any golf club would. This allows and provides a place for the players to place their drink while walking, or while their golf bag is on the ground.

BRIEF SUMMARY OF THE INVENTION

To minimize the limitations in the prior art, and to minimize other limitations that will be apparent upon reading and understanding the present specification, the present invention describes a stabilizing cup holder for any types of golf bags. The disclosed invention is a significant improvement in the state of the art by allowing players to store canned beverages simply and effectively in the cup holder while playing the golf.

In an embodiment of the present invention, a cup holder has been disclosed that fits inside any golf bag, just as any golf club would. This allows and provides a place for the players to place their drinks (such as the canned beverages) while walking, or while their golf bags are on the ground. The disclosed cup holder has a 2-axis gimbal mechanism which secures the cup holder at the end of a stick. This helps minimize spillage while walking, and always assures levelling of the drinks while stationary. The cup holder may be designed to secure a wide variety of drinks commonly found on a golf course including, but not limited to, 16 oz Solo Cup, a 12 oz Beer Can, as well as Tallboys, water bottles, 12, 16, and 24 oz paper cups of coffee, some thermoses, and narrower Cans. Currently, the only cup holders on a golf course are either (1) built into a golf cart, or (2) an add-on attachment for a golf bag pushcart i.e., Bagboy, Clicgear, or Sun Mountain. There is no cup holder that is designed and intended to be used on an isolated golf bag.

In an embodiment, the cup holder, as disclosed herein, comprises a rod (such as a telescoping rod or a stationary rod) with a threaded end. The cup holder further comprises an angled connector with a threaded end and a bearing end. A person having ordinary skills in the art would understand that other fastening means, such as rivets, pins, press-fit, or weld may be used instead of the threaded end without limiting the scope of the present invention. The angled connector may be inclined at an angle between 90-180 degrees, preferably, 120-degrees, 135-degrees, or 150-degrees angled connector. The cup holder further comprises a U-shaped connector that connects to the bearing end of the angled connector. The cup holder further comprises a cup that swings freely inside the U-shaped connector. The cup holder further comprises a rubber grommet inside the cup.

Various advantages, parts, and features of the cup holder of the present invention will be described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of various examples. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE INVENTION

Before describing the present invention in detail, it should be observed that the present invention utilizes a combination of components, which constitutes a cup holder for use with any type of golf bag. The disclosed cup holder can be easily fitted to the golf bag, thereby facilitating a stable storage area, which allows players to store canned beverages in the cup holder while drinking and playing the golf on a golf course. Accordingly, the components have been represented, showing only specific details that are pertinent for an understanding of the present invention so as not to obscure the disclosure with details that may be readily apparent to those with ordinary skill in the art having the benefit of the description herein. As required, the detailed embodiments of the present invention are disclosed herein. However, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The words "comprising", "having", "containing", and "including", and other forms thereof, are intended to be equivalent in meaning and open-ended in that an item or items following any one of these words is not meant to be an exhaustive listing of such item or items or meant to be limited to only the listed item or items.

The cup holder will now be described with reference to the accompanying drawings, particularly FIGS. 1-5, which should be regarded as merely illustrative without restricting the scope and ambit of the present invention.

Figure 1:
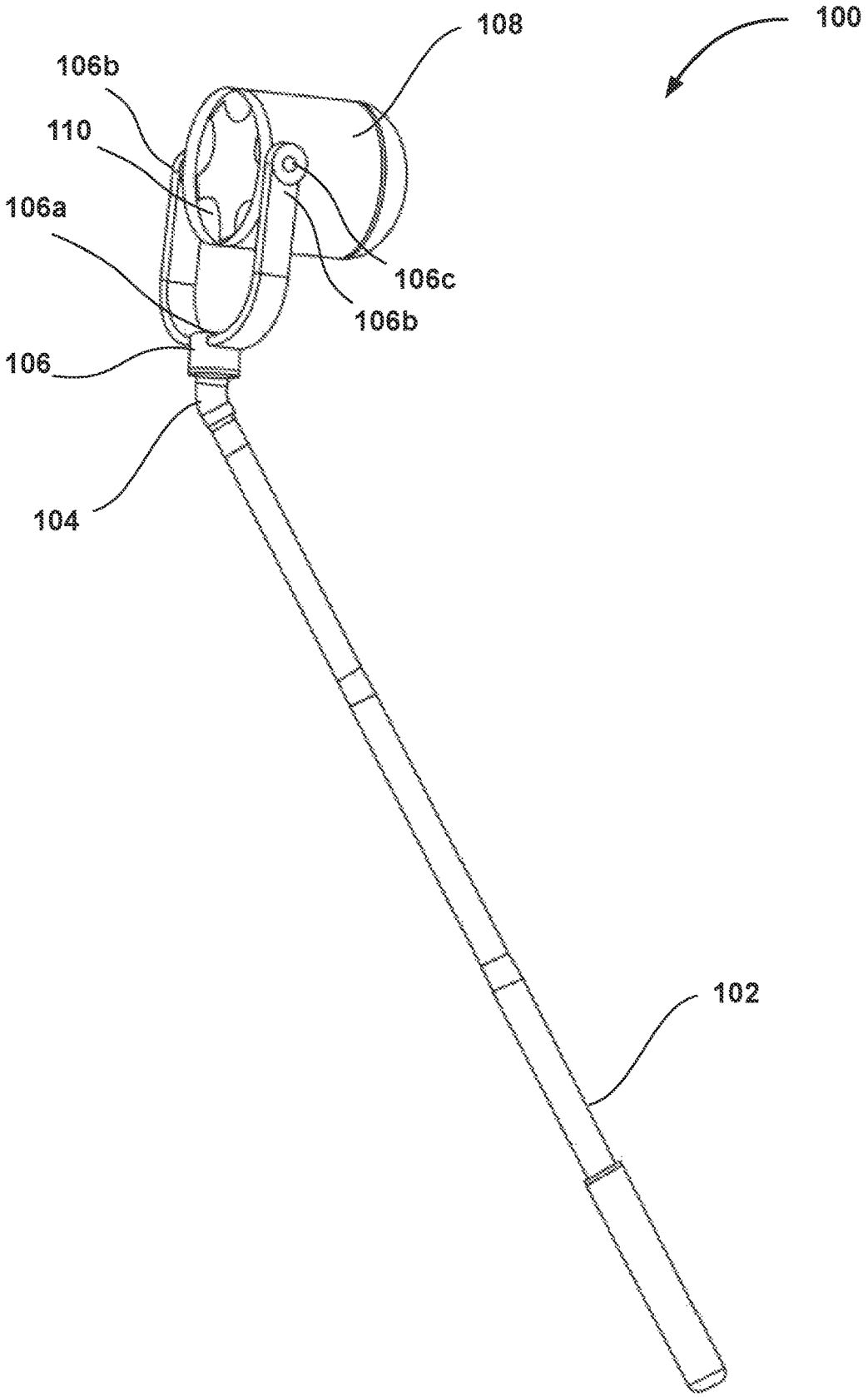
FIG. 1 is a diagram that illustrates a cup holder that can be used with any golf bag, according to an exemplary embodiment of the present invention.
Figure 2:
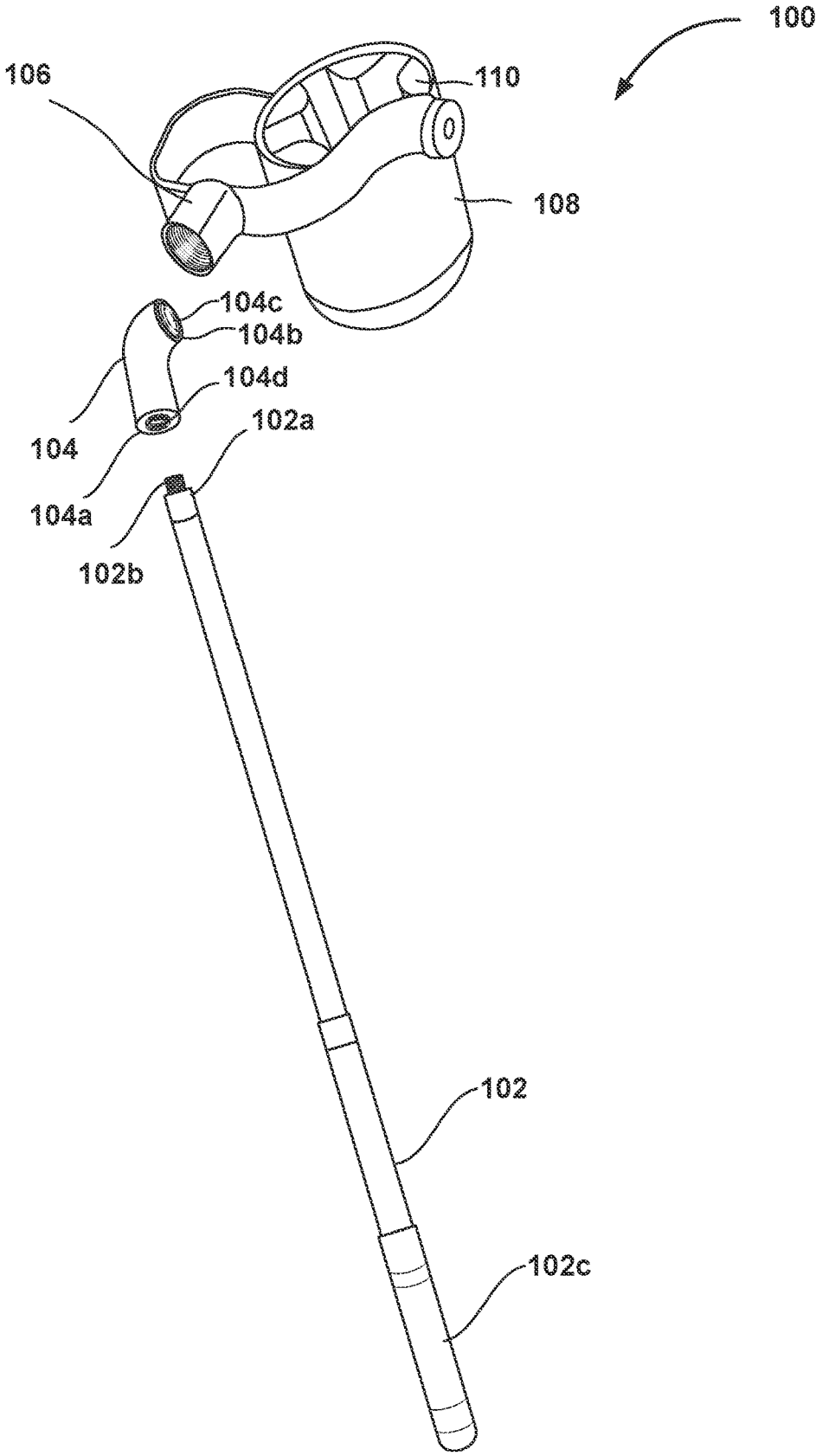
FIG. 2 is an exploded view of the cup holder of FIG. 1.
Figure 4:
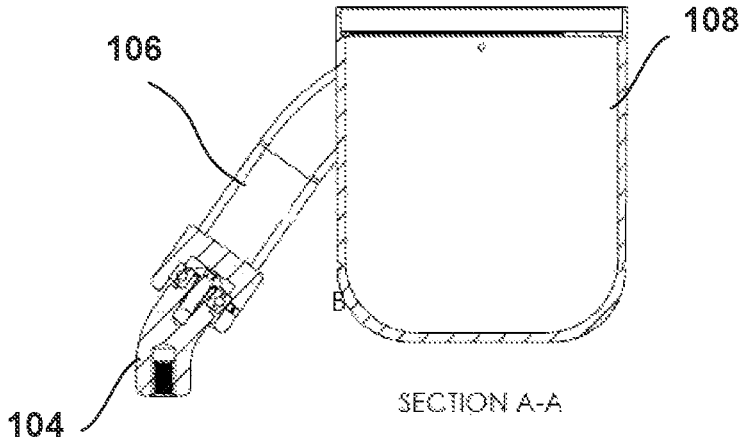
FIG. 4 shows a sectional view taken along A-A of FIG. 3.
Figure 3:
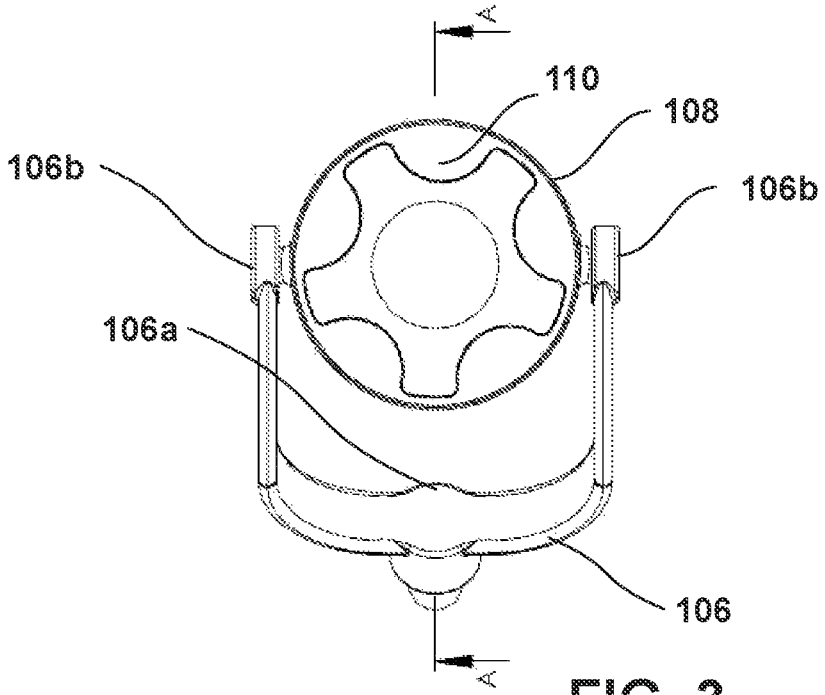
FIG. 3 shows a top view of a cup swingably connected to a U-shaped connector which is connected to an angled connector.

FIGS. 1-2 are diagrams that illustrate a cup holder 100 and an exploded view thereof that can be used with any golf bag, according to an exemplary embodiment of the present invention. FIG. 3 shows a top view of a cup swingably connected to a U-shaped connector which is connected to an angled connector and FIG. 4 shows a sectional view taken along A-A of FIG. 3. Referring to FIGS. 1-4, The cup holder 100 comprises a rod 102 (such as a telescoping rod or a stationary rod) with a first threaded end 102*a*. The threaded end 102*a* comprises a threaded screw 102*b* extending therefrom. The cup holder 100 further includes an angled connector 104 with a second threaded end 104*a* having female threads 104*d*. The angled connector 104 further includes a bearing end 104*b* having a bearing 104*c*. The cup holder 100 further includes a U-shaped connector 106 that connects to the bearing 104*c* present at the bearing end 104*b*, a cup 108 that swings freely inside the "U" connector, and a grommet 110 inside of the cup 108. A person having ordinary skills in the art would understand that other fastening means, such as rivets, pins, press-fit, or weld may be used instead of the threaded end without limiting the scope of the present invention. In an embodiment, the rod 102 may be made of a metallic or wooden, or plastic material. The rod 102 is an essential component of the cup holder 100 and cannot be replaced as the cup holder 100 would not be compact and easy to transport. It would also not allow for adjustability for different depths of golf bags. The connectors 104, 106 may be made of the same material as that of the rod 102. In some instances, a material used for the connectors 104, 106 may be different from a material used for the rod 102. The angled connector 104 cannot be replaced as the cup 108 would be positioned in line with golf clubs and would get in the way during regular golfing or operation. Additionally, the bearing 104*c* allows for the cup 108 to swing back and forth with gravity. The U-shaped connector 106 cannot be replaced as there would be no method to connect the cup 108 to the bearing 104*c* at the bearing end 104*b* of the angled connector 104 and would not allow the cup 108 to swing freely. The cup 108 may also be made of the same material as that of the rod 102, or a different material. Like other parts, the cup 108 cannot be replaced as there would be no method to hold the canned beverages. The grommet 110 is generally made of a rubber, however it is possible that the grommet 110 may be made of other material. Thus, all components of the cup holder 100, as disclosed, are essential and integral parts and cannot be replaced.

Figure 5:
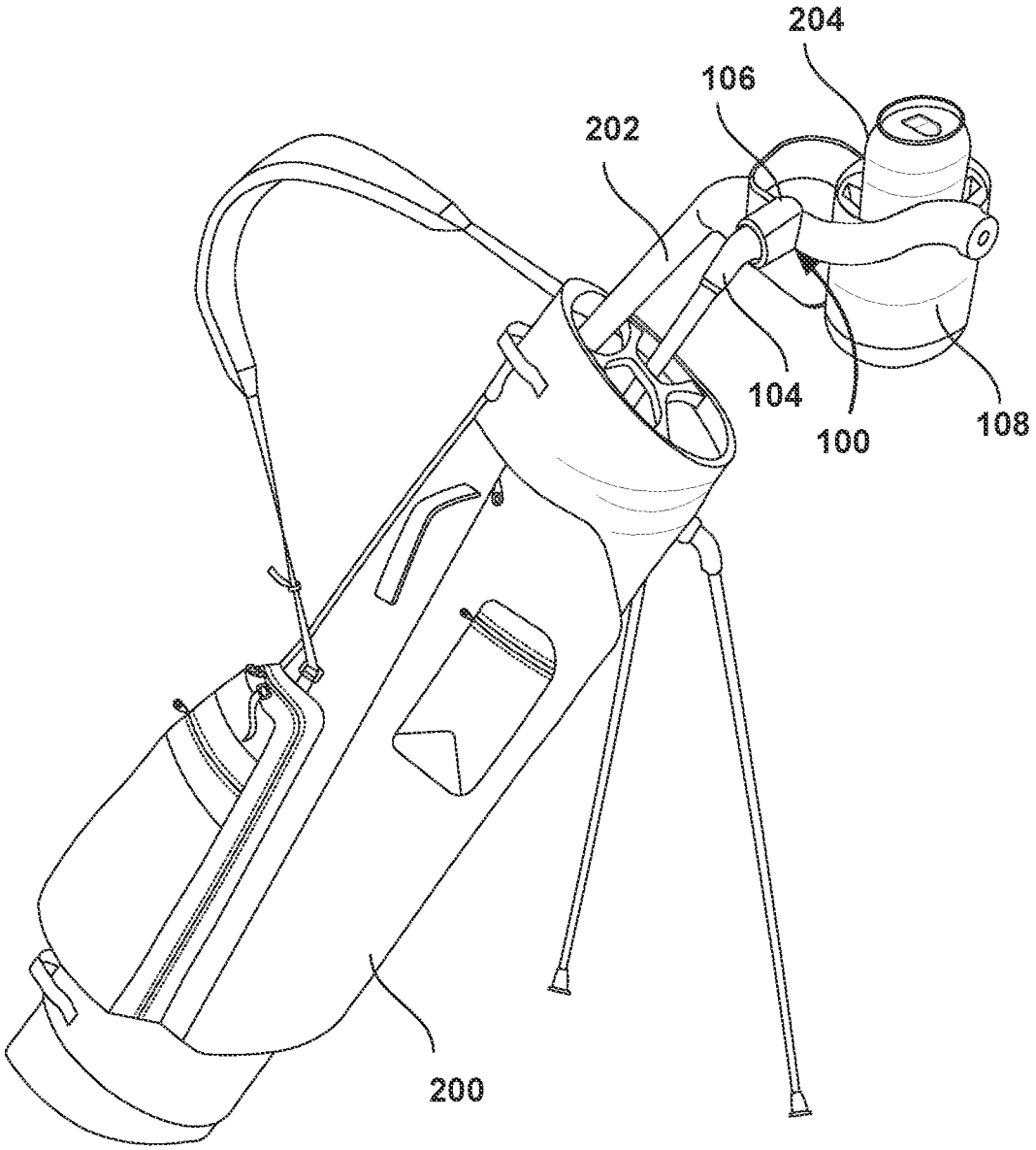
FIG. 5 shows the cup holder of the present invention placed inside a golf bag for facilitating a player to place his drink thereon.

In an embodiment, the rod 102, such as a telescoping rod or a stationary rod 102, may be designed to allow for the length to be adjusted to fit various sizes of golf bags and to also be packaged compactly. The threaded end 102*a* (particularly upwardly extending male thread 102*b*) allows the rod 102 to be disconnected for packing. However, a person having ordinary skills in the art would understand that other fastening means, such as rivets, pins, press fit, or weld may be used instead of the threaded end 102*a* without limiting the scope of the present invention. The angled connector 104 may allow the cup 108 to clear the outside of the golf bag when the golf bag is set on the ground and be clear of any and all clubs. The U-shaped connector 106 connects to the bearing end 104*b* of the angled connector 104 (via bearing 104*c*) to create one portion of a gimbal for the cup 108, thereby allowing the cup 108 to swing freely. The cup 108 is generally designed to hold or store the canned beverages (204) as shown in FIG. 5. The rubber grommet 110 allows for multiple sizes of canned beverages to be placed in the cup 108.

Now, the various components of the cup holder will be described in detail:

Rod 102: It is a rod (such as a telescoping rod or a stationary rod) consisting of multiple individual tubes (such as metal tubes) that are fitted to allow them to slide in and out of each other adjusting the total length of the rod 102. At one end of the rod 102 is a rubber or plastic handle 102*c* to allow for gripping, and on the other end is a threaded end 102*a* (with a threaded screw 102*b* extending upwardly) that is used to connect to the angled connector 104. The rod 102 is generally a telescoping, collapsing, or stationary rod which slides into the golf bag as an anchor just as any golf club would. This part is crucial because it acts as the anchor for the cup holder 100 itself. The golf bag is designed to carry clubs securely. The rod 102 is a similar shape and size to a golf club, which makes it the perfect shape to be an anchor which can be utilized with virtually any golf bag. Other inventions such as alignment sticks, and ball retrieves have had the same thought. Since this particular rod 102 is telescoping, it is also easy to collapse and fit inside of the pouch of the golf bag while not in use.

Angled Connector 104: This is a slightly angled connector made from plastic or metal. On one end 104*a* of the angled connector 104 is a threaded hole 104*d* to allow the connector 104 to connect with the threaded end 102*a* of the rod 102. The other end 104*b* allows for the mounting of a ball bearing 104*c*. This connector 104 may be inclined at an angle between 90-180 degrees, preferably, but should not be construed as limited to, 120-degrees, 135-degrees, or 150-degrees. This angled connector 104 may connect the rod 102 to the U-shaped connector 106 as shown in FIG. 1. This small piece angled connector 104 connects the rod 102 to the gimbal itself. It helps lower the centre of gravity and keeps the beverage out of the way of your golf clubs.

U-shaped connector 106: This is a plastic part and at the bottom of the 'U' is connected to the outer race of the ball bearing 104*c* with a friction fit and set screw. The depth 106*a* of the 'U' allows for the cup 108 when inserted to swing freely. The upper ends 106*b* of the 'U' have holes that allow for screws 106*c* to be inserted that screw into the cup 108, connecting the cup 108 to the 'U' and allowing the cup 108 to swing freely. This connector 106 generally has 2 axis gimbal that attaches to the 150-degree angled connector 104. This 2-axis gimbals have been commonly used to stabilize cameras while a photographer or videographer is in motion. The double-axis gimbal is a device that permits a body to incline freely in any direction or suspends it so that it will remain level when its support is tipped. A golf bag is constantly being tipped, picked up, put down, and jostled while in motion. A person having ordinary skills in the art would understand that the scope of the present invention is not limited to this connector being U-shaped. Another appropriated shaped connector may be used without limiting the scope of the present invention. For example, in some scenarios, the shape of the U-shaped connector may be adjusted to be more downward sloping but still looks like the U-shaped connector.

Cup 108: This is a plastic part that is deep and wide enough to accommodate various drink sizes including but not limited to 12 oz aluminum cans, skinny aluminum cans, solo cups, and tallboy aluminum cans. The cup is deep enough that it maintains a low centre of gravity (which helps stabilize the beverage), but not too deep that the beverage is too low to remove by hand. The depth and width of the cup holder may be designed with the dimensions of the most popular canned beverages such as a 12 oz beer can and 16 oz solo cup.

Grommet 110: This is a rubber part that is attached to the inside of the cup 108 with adhesive. The grommet 110 is flexible and durable enough to allow for many different drinks to be inserted and removed thousands of times over the life of the product. These are generally rubber teeth inside of the cup 108 which adequately secure an array of beverages. The rubber teeth inside of the cup 108 ensures the flexibility. The rubber teeth of the grommet 110 secure a wide variety drink sizes and cup sizes. The tackiness of the rubber prevents the drinks from swivelling, or jumping out of the cup while in motion, the flexible nature of the rubber, creates a pressure which secures the beverage from moving.

FIG. 5 typically shows the cup holder 100 of the present invention placed inside a golf bag 200 for facilitating a golf player to place his drink (eg. a canned beverage) thereon. As seen, the cup holder 100 is placed inside the golf bag 200 just like any other golf club 202. Although FIG. 5 shows the golf bag 200 placed on a ground surface. It should be understood that the cup holder 100 can be efficiently used with the golf bag 200 when the golf bag 200 is being carried by the player or the caddie.

All parts of the disclosed cup holder may be made from different materials which would have cost and quality implications. There is no substitute for the ball bearing connecting the angled connector to the U-shaped connector. The screws connecting the U-shaped connector to the cup may be replaced with ball bearings which would require a more costly and complex design. The grommet may be made from different materials which would affect the ease of insertion and removal of drinks. The telescoping rod may be replaced with a fixed rod, but this would eliminate both adjustability and portability.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

The invention claimed is:

1. A cup holder (100) for a golf bag (200), comprising: a rod (102) provided with a first threaded end (102*a*) having a threaded screw (102*b*) extending therefrom; an angled connector (104) provided with a second threaded end (104*a*) having a threaded hole (104*d*), and a bearing end (104*b*) having a ball bearing (104*c*), wherein the threaded hole (104*d*) is configured to receive the threaded screw (102*b*) of the rod (102); a U-shaped connector (106) connected to an outer race of the ball bearing (104*c*) of the angled connector (104) a cup (108) connected to the U-shaped connector (106) to swing freely therein; and a grommet (110) configured inside the cup (110).

2. The cup holder (100) of claim 1, wherein the rod (102) is a stationary rod.

3. The cup holder (100) of claim 1, wherein the rod (102) is a telescoping rod consisting of a plurality of individual tubes configured to slide in and out of each other to allow adjustment of the length of the rod (102).

4. The cup holder (100) of claim 1, wherein the rod (102) consists of a handle (102*c*) to allow for gripping of the cup holder (100).

5. The cup holder (100) of claim 1, wherein the angled connector (104) is inclined at an angle between 90-180 degrees.

6. The cup holder (100) of claim 1, wherein the angled connector (104) is inclined at 120 degrees or 135 degrees or 150 degrees.

7. The cup holder (100) of claim 1, wherein the U-shaped connector (106) is connected to the outer race of the ball bearing (104*c*) of the angled connector (104) using a friction fit and set screw.

8. The cup holder (100) of claim 1, wherein depth (106*a*) of the U-shaped connector (106) allows for the cup (108) when inserted therein to swing freely and upper ends (106*b*) of the U-shaped connector (106) having holes allow for screws (106*c*) to be inserted that screw into the cup (108), connecting the cup (108) to the U-shaped connector (106) allowing the cup (108) to swing freely.

9. The cup holder (100) of claim 1, wherein the U-shaped connector (106) includes a 2-axis gimbal that attaches to the angled connector (104) and is used to stabilize a canned beverage (204) placed within the cup (108) of the cup holder (100).

10. The cup holder (100) of claim 1, wherein the cup (108) is appropriately sized to accommodate different drink sizes and is made deep enough to maintain a lower center of gravity to help stabilize a canned beverage (204) placed inside the cup (108).

11. The cup holder (100) of claim 1, wherein the grommet (110) comprises a plurality of teeth that secure a wide variety of drink sizes and cup sizes.

* * * * *